US005779046A

United States Patent [19]

Plakos

[11] Patent Number: 5,779,046

[45] Date of Patent: Jul. 14, 1998

[54] DECORATIVE TOOTHBRUSH GUARD

[75] Inventor: Andrew E. Plakos, Irvine, Calif.

[73] Assignee: Strottman International, Inc., Irvine, Calif.

[21] Appl. No.: 831,144

[22] Filed: Apr. 1, 1997

[51] Int. Cl.[6] ..... B65D 85/00

[52] U.S. Cl. ..... 206/362.3; 206/457

[58] Field of Search ..... 206/15.2, 15.3, 206/209.1, 361, 362, 362.1–362.4, 457

[56] References Cited

U.S. PATENT DOCUMENTS

| | | | |
|---|---|---|---|
| 634,906 | 10/1899 | McCloskey | 206/362.3 |
| 1,041,315 | 10/1912 | Marx | 206/362.3 |
| 1,444,368 | 2/1923 | Conely | 206/362.3 |
| 1,483,035 | 2/1924 | Wyatt . | |
| 1,506,257 | 8/1924 | Schmidt | 206/362.3 |
| 2,112,658 | 3/1938 | Rathbun | 206/362.3 |
| 2,121,488 | 6/1938 | Nofz . | |
| 2,331,222 | 10/1943 | Oshman et al. | 26/362.3 |
| 2,507,342 | 5/1950 | Licari et al. | 206/362.3 |
| 3,127,985 | 4/1964 | Scott | 206/362.3 |
| 4,521,128 | 6/1985 | O'Neal . | |
| 5,044,039 | 9/1991 | Picard . | |
| 5,259,086 | 11/1993 | Fong . | |

FOREIGN PATENT DOCUMENTS

| | | |
|---|---|---|
| 1155120 | 4/1958 | France . |
| 2157234 | 5/1973 | Germany . |

*Primary Examiner*—Jimmy G. Foster
*Attorney, Agent, or Firm*—Richard C. Litman

[57] ABSTRACT

A decorative toothbrush guard which covers nearly the entire head of a toothbrush thereby preventing germs or dust from coming into contact with the head. More specifically, the present invention includes an upper and a lower cover portion connected by a hinge. The upper and lower cover portions each have an inner cavity which can house a toothbrush head. The lower cover portion has a seat portion integrally connected therein for holding the toothbrush head. The toothbrush guard can be slipped over the toothbrush head and firmly secured thereon by a plurality of frictionally interlocking rods and holes on the upper and lower cover portions. The lower cover portion has a slot which not only allows for the insertion of a toothbrush neck or upper handle through the lower cover portion, but also allows air to circulate within the cover portion to facilitate drying of the toothbrush head. The preferred embodiment of the present invention is made of a single piece of flexible material. Also the outer surface of the toothbrush guard can be formed to resemble a head of a cartoon character, television personality, or other person or animal to help encourage children to brush their teeth.

16 Claims, 3 Drawing Sheets

DECORATIVE TOOTHBRUSH GUARD

BACKGROUND OF THE INVENTION

1. FIELD OF THE INVENTION

The present invention relates to a decorative toothbrush guard which covers nearly the entire head of a toothbrush thereby preventing germs or dust from coming into contact with the head. More specifically, the present invention includes an upper and a lower cover portion connected by a hinge which allows the guard to be slipped over the head of a toothbrush and firmly secured thereon.

2. DESCRIPTION OF PRIOR ART

A toothbrush can be an ideal transporter of germs due to the fact that it is placed within the mouth of the user on a daily basis. Merely rinsing the toothbrush in warm water prior to using it may not remove or kill all of the germs present on the toothbrush. Children are at an even greater risk since they may forget to rinse the toothbrush off before placing it in their mouths.

The bathroom of any home can be a breeding ground for germs. Dust particles floating through the air and eventually settling on items in the bathroom may carry germs. When a toothbrush is placed on the bathroom counter top or dropped on the floor the potential arises of contaminating the toothbrush with germs. Also carrying a toothbrush in a travel bag with other toiletry items can contaminate the toothbrush with germs or other unwanted substances. Consequently there is a need for a device which can significantly reduce the presence of germs on a toothbrush head and thereby reduce the risk of transferring germs to the user of the toothbrush.

Due to the fact that a toothbrush is wet after use, the device should allow the toothbrush head sufficient ventilation to dry. By allowing the toothbrush to dry after use the device will further ensure that the toothbrush head is maintained in a sanitary condition.

A single embodiment of the device should be capable of being used with a wide variety of sizes and styles of toothbrush heads and toothbrush handles. The device could also be designed to help encourage children to brush their teeth. The device should be both attractive and safe for young children to play with even while unattended.

Devices similar to the type described above have been the subject of earlier patents, yet they have all failed to adequately achieve the goals set forth above. The following patents and patent applications are examples of such devices.

U.S. Pat. No. 1,483,035, issued on Feb. 5, 1924, to William E. Wyatt discloses a wall mounted toothbrush holder capable of supporting and protecting the heads of a plurality of toothbrushes in a sanitary condition and having a transparent cover. U.S. Pat. No. 2,121,488, issued on Jun. 21, 1938, to Henry Nofz discloses a toothbrush holder similar to that disclosed in the Wyatt patent, but which also includes a means for resiliently gripping the handles of the toothbrushes within the holder. Both the patent to Wyatt and the patent to Nofz are designed to be mounted on a bathroom wall and therefore lack the ability to protect a user from contamination when a toothbrush is placed in a travel bag. Both patents also fail to disclose any feature which will encourage children to use the device.

U.S. Pat. No. 4,521,128, issued on Jun. 4, 1985, to Chester L. O'Neal discloses a combination toothbrush and toothpaste dispenser having an enclosure cap which snaps onto a specially designed toothbrush head thereby enclosing the bristles of the toothbrush and plugging the dispensing orifice. The patent to O'Neal fails to protect the user from contamination on the back side of the toothbrush head and it fails to give the bristles a way to dry effectively.

U.S. Pat. No. 5,044,039, issued on Sep. 3, 1991, to Pierre E. Picard discloses a protective cap which grips to the handle of a toothbrush and extends mainly on one side of the handle to cover the bristles and has peripheral apertures for allowing ventilation of the bristles. French Patent Number 1,155,120, published on Apr. 23, 1958, discloses a toothbrush cap which snaps into a specially designed groove on the head of a toothbrush head thereby covering the bristles. The patent to Picard and the French patent fail to protect the user from contamination on the back side of the toothbrush head. Both patents also limit the variety of sizes and styles of toothbrush heads and toothbrush handles that they may be used with due to the shape of the head cap and the fact that the cap snaps snugly onto a particularly shaped handle.

U.S. Pat. No. 5,259,086, issued on Nov. 9, 1993, to Peter S. Fong discloses a child's toothbrush having a removably attachable music box which attaches to the end of the handle opposite the head and encourages brushing. The patent to Fong fails to disclose any features to protect the toothbrush head from contamination by germs.

German Patent Number 2,157,234, published on May 24, 1973, discloses a toothbrush cap similar in design to a fountain pen cap which snaps into a specially designed groove around the handle of the toothbrush thereby covering the head and the bristles of the toothbrush. The German patent is limited in the variety of sizes and styles of toothbrushes that it may be used with due to the fact that the cap is specially designed to fit a particularly shaped handle. The German patent also fails to disclose any feature which will encourage children to use the device.

None of the above inventions and patents, taken either singularly or in combination, is seen to describe the instant invention as claimed. Thus a toothbrush guard solving the aforementioned problems is desired.

SUMMARY OF THE INVENTION

The present invention is a decorative and completely functional toothbrush guard which covers nearly the entire head of a toothbrush thereby preventing germs or dust from coming into contact with the head. More specifically, the present invention includes an upper and a lower cover portion connected by a hinge. The upper and lower cover portions each have an inner cavity which can house a toothbrush head. The lower cover portion has a seat portion integrally connected therein for holding the toothbrush head. The toothbrush guard can be slipped over the toothbrush head and firmly secured thereon by a plurality of frictionally interlocking rods and holes which are connected to the upper and lower cover portions. The lower cover portion has a slot which not only allows for the insertion of a toothbrush neck or upper handle through the lower cover portion, but also allows air to circulate within the cover portion to facilitate drying of the toothbrush head. The preferred embodiment of the present invention is made of a single piece of flexible material. Also the outer surface of the toothbrush guard can be formed to resemble a head of a cartoon character, television personality, or other person or animal to help encourage children to brush their teeth.

Accordingly, it is a principal object of the invention to provide a decorative toothbrush guard which covers substantially the entire head of a toothbrush thereby preventing germs or dust from coming into contact with the head.

It is another object of the invention to provide a toothbrush guard design in which a single embodiment of the guard is capable of being used with a wide variety of sizes and styles of toothbrush heads and toothbrush handles.

It is a further object of the invention to provide a toothbrush guard which allows air to circulate around the head and bristles of the toothbrush to allow the bristles to dry after the toothbrush is used.

Still another object of the invention is to provide a toothbrush guard which encourages children to brush their teeth and which is safe for young children to play with even while unattended.

It is an object of the invention to provide improved elements and arrangements thereof in a toothbrush guard for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
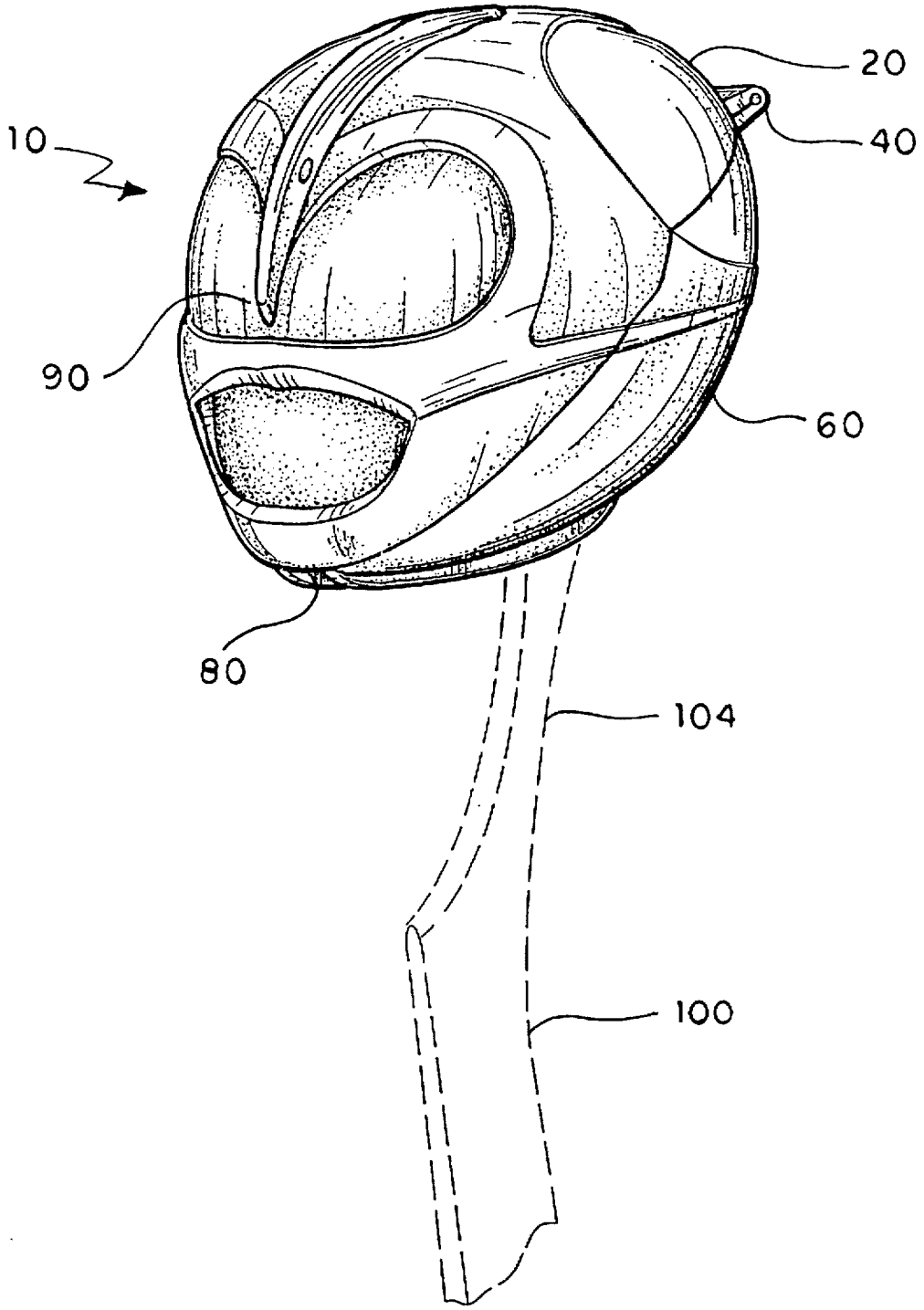
FIG. 1 is a perspective view of a toothbrush guard according to the present invention showing the cover portions in the closed position and showing a toothbrush using phantom lines.
Figure 2:
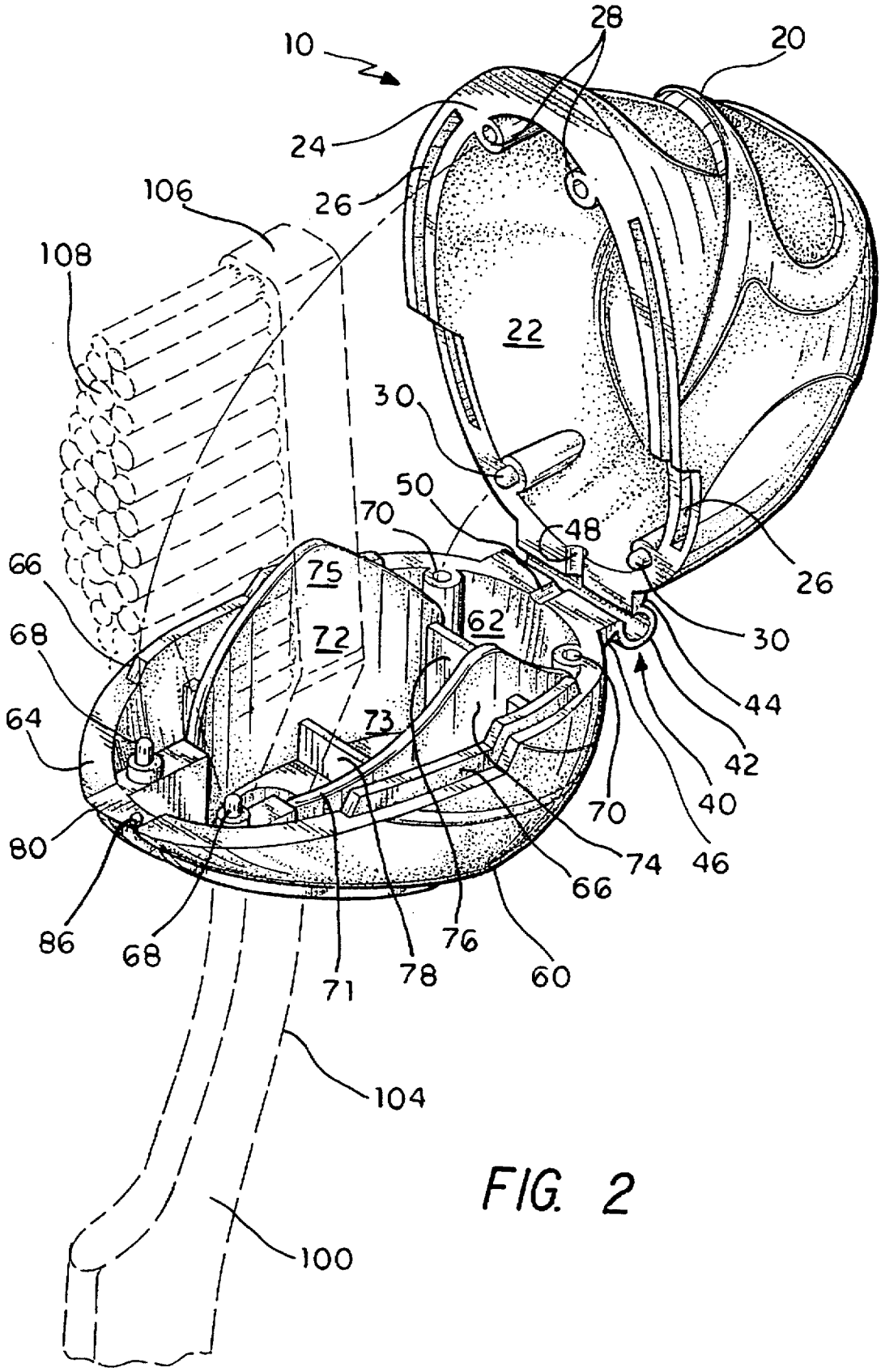
FIG. 2 is a perspective view of a toothbrush guard according to the present invention showing the cover portions in the open position exposing the inner features of the present invention and showing a toothbrush using phantom lines.

As shown in FIGS. 1 and 2, the present invention relates to a toothbrush guard 10 which covers nearly the entire head 106 of a toothbrush 100 thereby preventing germs or dust from coming into contact with the head 106. More specifically, the present invention includes an upper 20 and a lower 60 cover portion connected by a hinge 40 which can be slipped over the head of a toothbrush 106 and firmly secured thereon.

FIG. 2 shows one embodiment of the toothbrush guard 10 in the open position exposing the inner features of the present invention and showing the guard's 10 relationship with a toothbrush 100 which is shown using phantom lines. The toothbrush guard 10 includes an upper cover portion 20, a lower cover portion 60 having a slot 80, a seat portion 71 integrally connected to the lower cover portion 60, a hinge 40, and a plurality of interconnecting rods and holes, 28, 30, 68, and 70, used to hold the upper and lower cover portions firmly together when in the closed position.

Figure 3:
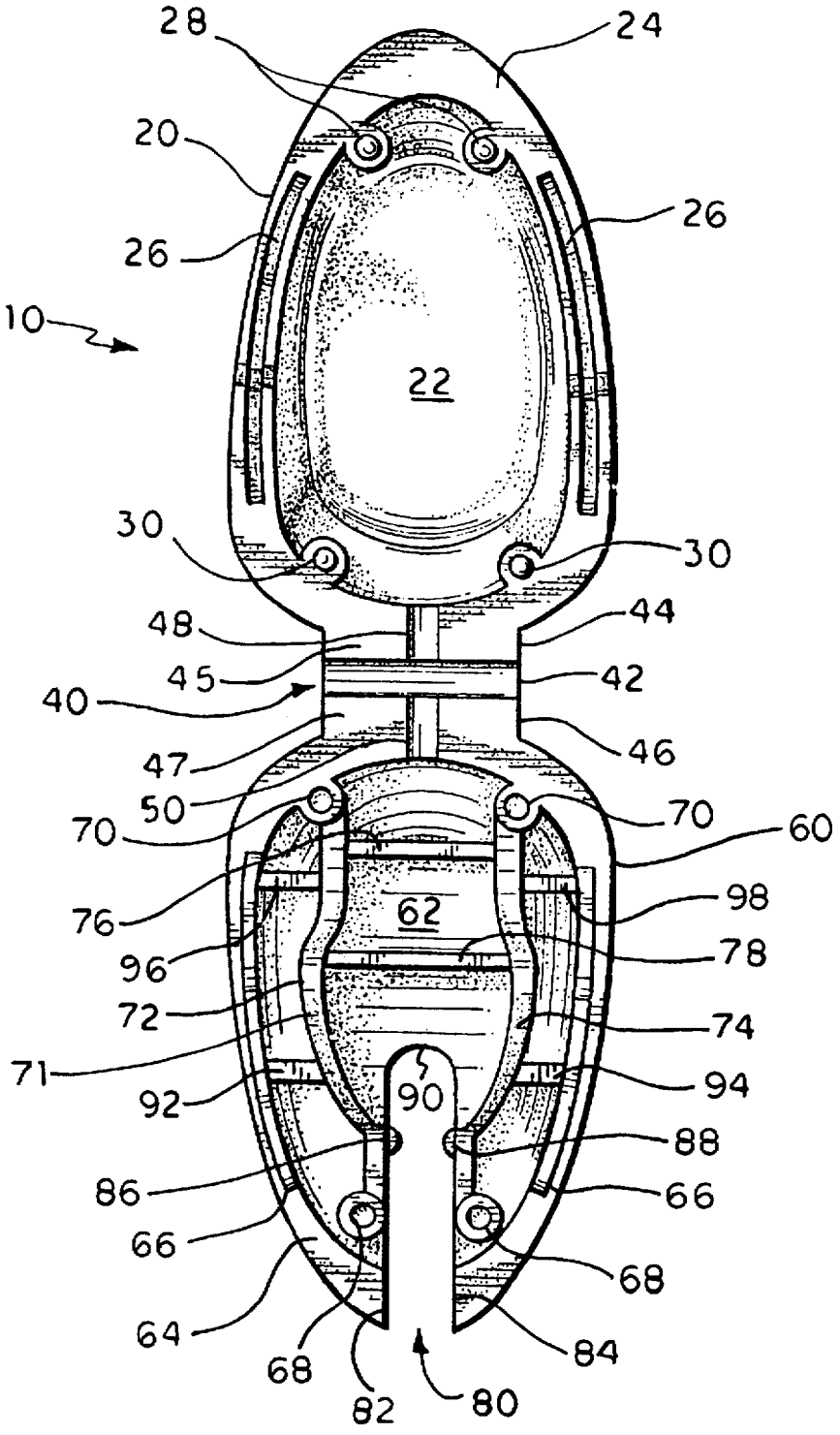
FIG. 3 is a plain view of the inner cavities of the upper and lower cover portions of a toothbrush guard according to the present invention.

The upper cover portion 20, as shown in FIGS. 2 and 3, has an inner cavity 22 which is generally an open area within the toothbrush guard 10 large enough to enclose a toothbrush head 106 when in the closed position. The upper cover portion 20 has an edge 24 which extends around the inner cavity 22. Similarly, the lower cover portion 60 has an inner cavity 62 which is generally an open area within the toothbrush guard 10 large enough to enclose a toothbrush head 106 when in the closed position. The lower cover portion 60 also has an edge 64 which extends around its inner cavity 62.

The upper cover portion 20 is pivotally connected to the lower cover portion 60 by a hinge 40. The hinge 40 of the preferred embodiment, as shown in FIGS. 1, 2 and 3, is what is typically referred to as a living joint. The hinge 40 is composed of one continuous piece of flexible material which is integrally connected to the upper cover portion 20 and the lower cover portion 60. The material used could be either a type of rubber or flexible plastic or other similar material. The material used would have to be able to withstand repeated flexing without yielding or fracturing. One benefit of using a living joint in the present invention is that it reduces the number of parts which can break off and potentially be swallowed by a young child. Alternatively, conventional types of hinges may be used to achieve a sufficient result if appropriate safety precautions are taken.

The living hinge 40 of the preferred embodiment includes a pair of relatively thick sections, 44 and 46, which are joined by a thinner section 42. The thin section 42 allows the hinge 40 to bend as would a conventional hinge around its axis. Thick section 44 is integrally connected to the upper cover section 20 and thick section 46 is integrally connected to lower cover section 60. Thick sections 44 and 46 each have an inner surface, 45 and 47 respectively. Inner surfaces 45 and 47 each have a channel, 48 and 50 respectively, which extends through edges 24 and 64 respectively. Channels 48 and 50 allow the living joint to flex slightly around an axis perpendicular to the conventional hinge axis and parallel to the axes of the channels 48 and 50. This slight flexing allows the users of the toothbrush guard 10 to more easily open the guard by squeezing the sides of the guard, as is more fully discussed below.

The upper 20 and lower 60 cover sections have a plurality of interconnecting rods and holes, 28, 30, 68, and 70, used to hold the upper and lower cover portions firmly together when in the closed position. The interconnecting rods and holes are aligned such that when the rods and holes are interlocked the upper cover portion edge 24 should sit flush with lower cover portion edge 64. The rods and holes interlock because the rods are slightly larger in diameter than the holes such that when a rod is forced within a hole the friction between the rod and the hole will resist the rod easily sliding out of the hole.

In the preferred embodiment of the present invention, as shown in FIGS. 2 and 3, the upper cover portion 20 has a pair of holes 28 integrally connected to the front end of the inner cavity 22 and a pair of rods 30 integrally connected to the rear of the inner cavity 22. The lower cover portion 60 has a pair of rods 68 integrally connected to the front end of the inner cavity 62 and a pair of holes 70 integrally connected to the rear end of the inner cavity 62. Alternatively, the number and configuration of interlocking rods and holes may be varied, as well as the cross-sectional shape of the rods and holes. The frictional forces created between the rods and the holes are generally sufficient to withstand the impact of being dropped on the floor without releasing the guard 10 from the toothbrush head 40.

In the preferred embodiment, the edge 24 of the upper cover portion 20 has a pair of alignment grooves 26 and the edge 64 of the lower cover portion 60 has a pair of matching alignment ridges 66. The matching grooves 26 and ridges 66 are aligned such that when the toothbrush guard 10 is in the closed position the upper cover portion edge 24 should sit flush with lower cover portion edge 64. Alternatively, the alignment ridges could be on the edge 24 of the upper cover portion 20 and the alignment grooves could be on the edge 64 of the lower cover portion 60. The height and length of the ridges and depth and length of the grooves can be varied.

Preferably the entire toothbrush guard 10 is made from a single piece of flexible material. The material used could be either a type of rubber or flexible plastic or other similar material. The material used would have to be able to withstand repeated flexing without yielding or fracturing. One benefit of constructing the entire toothbrush guard 10 from a single piece of material is that it reduces the number of parts which can break off and potentially be swallowed by a young child. However, if the proper precautions are taken the toothbrush guard 10 may be constructed of several pieces which may reduce manufacturing costs.

The toothbrush guard 10 can be opened using a variety of methods. The users can open the guard 10 by lifting up on the edge 24 of the upper cover portion 20 where the slot 80 meets the edge 24. In the preferred embodiment, the toothbrush guard 10 is made from a flexible material which would allow the user to squeeze the sides of the guard 10 at a location adjacent to the alignment grooves 26 and alignment ridges 66. When the sides of the guard 10 are squeezed the interlocking friction between the rods 30 and 68 and the holes 28 and 70 is overcome and the upper 20 and lower 60 cover portions are forced apart in a manner similar to opening a peanut shell.

The channels, 48 and 50, in the hinge 40 allow the living joint to flex slightly around an axis perpendicular to the conventional hinge axis and parallel to the axes of the channels, 48 and 50, thereby further facilitating the opening process. The alignment ridges 66 also perform a secondary function when the sides of the guard 10 are squeezed. When the guard 10 is squeezed the alignment ridges 66 are forced against the alignments grooves 26 and thereby push the lower cover portion 60 away from the upper cover portion 20. This squeezing motion is relatively easy for a young child to master.

In the preferred embodiment, the lower cover portion 60 has a slot 80 extending from the front end of the lower cover portion edge 64 to the seat portion 71. The slot has a pair of substantially parallel inner edges, 82 and 84, which are spaced wide enough apart to allow the neck or upper handle 104 of a toothbrush to slide to the rear of the slot 80 to a position at or near slot end 90. Inner edges 82 and 84 each have a protrusion, 86 and 88 respectively, extending therefrom which resist the tendency of the toothbrush neck or upper handle 104 from sliding along slot 80 away from slot end 90. The protrusions 86 and 88 are oriented opposite each other and are located at a position sufficiently away from slot end 90 such that the toothbrush neck or upper handle 104 can fit between the protrusions 86 and 88 and slot end 91). Alternatively, there may be several pairs of opposing protrusions along the inner edges of the slot.

The slot 80 acts as a ventilation system for the toothbrush guard 10. Slot 80 is large enough to allow sufficient air to circulate within inner cavities 22 and 62. The slot 108 will allow the head 106 and the bristles 108 of the toothbrush 100 to dry and therefore prevent any potential unsanitary conditions from occurring with the toothbrush guard 10 which may otherwise result from a continuously moist environment.

The seat portion 71 is integrally connected to the lower cover portion 60 within inner cavity 62 and is designed to receive a toothbrush head 106. In the preferred embodiment, the seat portion 71 includes a pair of opposed side walls, 72 and 74, and a pair of rear walls, 76 and 78, connecting the side walls. The side walls, 72 and 74, each have a base end 73 attached to the lower cover portion 60 and a terminal end 75.

Preferably the side walls, 72 and 74, are tapered in relation to each other from wide at the terminal end 75 to narrow at the base end. The taper allows the user to press the head of the toothbrush 106 between the side walls, 72 and 74, which pinch the sides of the head 106 thereby frictionally gripping the head 106. In this position the back of the head will come to rest on rear walls 76 and 78. To further increase to frictional grip of the head, the preferred embodiment has a rough textured surface on the side walls, 72 and 74, and the rear walls, 76 and 78. The side walls, 72 and 74, may also be given added support by placing brace walls 92, 94, 96, and 98 between the side walls, 72 and 74, and the sides of the lower cover portion 60.

The outer surfaces of the upper 20 and lower 60 cover portions have indicia 90 thereon which represent a head of a cartoon character, television personality, or other person or animal. The indicia 90 will help encourage children to brush their teeth. The indicia 90 shown in FIGS. 1, 2, and 3 is the head of a television show character known as a MIGHTY MORPHIN POWER RANGER®.

It is to be understood that the present invention is not limited to the embodiments described above, but encompasses any and all embodiments within the scope of the following claims.

I claim:

1. A toothbrush guard comprising:

an upper cover portion having an inner cavity therein with an edge therearound;

a lower cover portion having an inner cavity therein with an edge therearound, said lower cover portion having a slot;

a seat portion integrally connected within said inner cavity to said lower cover portion for receiving a toothbrush head therein, said slot extending from said edge of said lower cover portion to said seat portion, said seat portion including a pair of opposed side walls and a rear wall connecting said side walls, each of said side walls having a base end attached to said lower cover portion and a terminal end, and said side walls being tapered in relation to each other from wide at said terminal end to narrow at said base end;

a living hinge pivotally connecting said upper cover portion to said lower cover portion; and means for holding said edge of said upper cover portion flush with said edge of said lower cover portion.

2. The toothbrush guard as defined in claim 1 wherein said side walls and said rear wall of said seat portion have a textured surface thereon.

3. The toothbrush guard as defined in claim 2 wherein said slot has a pair of substantially parallel inner edges, said inner edges each having a protrusion thereon, said protrusions being oriented opposite each other.

4. The toothbrush guard as defined in claim 3 wherein said toothbrush guard is made from a flexible material.

5. The toothbrush guard as defined in claim 4 wherein said toothbrush guard is made from a single piece of said material.

6. The toothbrush guard as defined in claim 5 wherein said hinge is composed of one continuous piece of material, said hinge being integrally connected to said upper cover portion and to said lower cover portion.

7. The toothbrush guard as defined in claim 6 wherein:

said hinge has an inner surface, said inner surface being flush with said edges of said upper and said lower cover portion; and said inner surface of said hinge having a channel thereon, said channel is oriented perpendicular to the axis of said hinge and extends through said edges of said upper and lower cover portions.

8. The toothbrush guard as defined in claim 7 wherein said upper and said lower cover portions each have an outer surface, said outer surfaces having indicia thereon which represent a cartoon character, television personality, or other person or animal.

9. The toothbrush guard as defined in claim 8 wherein:

said edge of said upper cover portion has an alignment groove thereon; and said edge of said lower cover portion has an alignment ridge thereon, said ridge being oriented to mesh with said groove when said edge of said upper cover portion is flush with said edge of said lower cover portion.

10. The toothbrush guard as defined in claim 8 wherein:

said edge of said upper cover portion has an alignment ridge thereon; and said edge of said lower cover portion has an alignment groove thereon, said groove being oriented to mesh with said ridge when said edge of said upper cover portion is flush with said edge of said lower cover portion.

11. The toothbrush guard as defined in claim 9 wherein said holding means comprises:

a rod connected to said upper cover portion; and a hole connected to said lower cover portion and aligned with said rod, said hole being smaller in diameter than said rod such that when said rod is forced within said hole the friction between said rod and said hole will hold said edge of said upper cover portion flush with said edge of said lower cover portion.

12. The toothbrush guard as defined in claim 10 wherein said holding means comprises:

a rod connected to said upper cover portion; and a hole connected to said lower cover portion and aligned with said rod, said hole being smaller in diameter than said rod such that when said rod is forced within said hole the friction between said rod and said hole will hold said edge of said upper cover portion flush with said edge of said lower cover portion.

13. The toothbrush guard as defined in claim 9 wherein said holding means comprises:

a rod connected to said lower cover portion; and a hole connected to said upper cover portion and aligned with said rod, said hole being smaller in diameter than said rod such that when said rod is forced within said hole the friction between said rod and said hole will hold said edge of said upper cover portion flush with said edge of said lower cover portion.

14. The toothbrush guard as defined in claim 10 wherein said holding means comprises:

a rod connected to said lower cover portion; and a hole connected to said upper cover portion and aligned with said rod, said hole being smaller in diameter than said rod such that when said rod is forced within said hole the friction between said rod and said hole will hold said edge of said upper cover portion flush with said edge of said lower cover portion.

15. The toothbrush guard as defined in claim 9 wherein said holding means comprises:

a rod and a hole connected to said lower cover portion; and a hole and a rod connected to said upper cover portion and aligned with said rod and said hole on said lower cover portion respectively, said holes being smaller in diameter than said rods such that when said rods are forced within said holes the friction between said rods and said holes will hold said edge of said upper cover portion flush with said edge of said lower cover portion.

16. The toothbrush guard as defined in claim 10 wherein said holding means comprises:

a rod and a hole connected to said lower cover portion; and a hole and a rod connected to said upper cover portion and aligned with said rod and said hole on said lower cover portion respectively, said holes being smaller in diameter than said rods such that when said rods are forced within said holes the friction between said rods and said holes will hold said edge of said upper cover portion flush with said edge of said lower cover portion.

* * * * *